US007806074B2

(12) United States Patent
Nomura et al.

(10) Patent No.: US 7,806,074 B2
(45) Date of Patent: Oct. 5, 2010

(54) COATING MACHINE AND ROTARY ATOMIZING HEAD THEREOF

(75) Inventors: Takao Nomura, Toyota (JP); Shigeyoshi Inada, Toyota (JP); Takashi Katsumata, Toyota (JP)

(73) Assignee: Trinity Industrial Corporation, Aichi (JP)

( * ) Notice: Subject to any disclaimer, the term of this patent is extended or adjusted under 35 U.S.C. 154(b) by 804 days.

(21) Appl. No.: 11/569,507

(22) PCT Filed: Mar. 23, 2005

(86) PCT No.: PCT/JP2005/005194

§ 371 (c)(1),
(2), (4) Date: May 23, 2007

(87) PCT Pub. No.: WO2005/113156

PCT Pub. Date: Dec. 1, 2005

(65) Prior Publication Data

US 2008/0245296 A1 Oct. 9, 2008

(30) Foreign Application Priority Data

May 24, 2004 (JP) ..... 2004/153030

(51) Int. Cl.
*B05B 3/00* (2006.01)
*B05B 3/04* (2006.01)
*B05B 3/10* (2006.01)
*F23D 11/04* (2006.01)

(52) U.S. Cl. ..... 118/323; 118/321; 239/223; 239/224; 239/222.11

(58) Field of Classification Search ..... 118/321, 118/323; 239/220, 223, 224, 380–383, 390, 239/396, 700, 703, 222.11–222.21
See application file for complete search history.

(56) References Cited

U.S. PATENT DOCUMENTS 7,014,713 B2 3/2006 Nakane (Continued)

FOREIGN PATENT DOCUMENTS

JP 17-3371 3/1942

(Continued)

OTHER PUBLICATIONS

English Translated doc of JP-2003-143727A, May 2002.*

(Continued)

*Primary Examiner*—Yewebdar T Tadesse
(74) *Attorney, Agent, or Firm*—Greenblum & Bernstein P.L.C.

(57) ABSTRACT

A coating machine is capable of reducing VOC and $CO_2$ by atomizing a paint to increase depositing efficiency without lowering production efficiency and the rotary atomizing head of the coating machine. The coating machine includes the rotary atomizing head in which a paint chamber receiving the supply of paint is formed on the rear side thereof. A plurality of rims formed in a roughly truncated conical shape for extending the paint flowing out of the paint chamber by a centrifugal force and atomizing the paint at the tip thereof are fitted in the rotary atomizing head overlappingly at specific clearances. The clearances are opened to the peripheral surface part of the paint chamber. Accordingly, VOC and $CO_2$ can be reduced by reducing the total jetted amount of paint to enable the atomization of the paint at low rotating speeds so as the increase the deposit efficiency.

2 Claims, 2 Drawing Sheets

U.S. PATENT DOCUMENTS 7,156,045 B2 1/2007 Ueno et al.

FOREIGN PATENT DOCUMENTS

| | | | |
|---|---|---|---|
| JP | 40-13113 | | 6/1965 |
| JP | 63-90449 | | 6/1988 |
| JP | 09-94489 | | 4/1997 |
| JP | 2002143727 A | * | 5/2002 |
| JP | 2002-301405 | | 10/2002 |
| JP | 2005-137980 | | 6/2005 |

OTHER PUBLICATIONS

Partial English language Translation of JP 40-13113, Jun. 25, 1965.
Partial English language Translation of JP 63-90449, Jun. 11, 1988.
Partial English language Translation of JP 17-3371, Mar. 19, 1942.
U.S. Appl. No. 11/569,509 to Nomura et al., which was filed on Nov. 22, 2006.
English language Abstract of JP 2002-301405, Oct. 15, 2002.
English language Abstract of JP 09-94489, Apr. 8, 1997.
English language Abstract of JP 2005-137980, Jun. 2, 2005.

* cited by examiner

COATING MACHINE AND ROTARY ATOMIZING HEAD THEREOF

TECHNICAL FIELD

The present invention concerns a rotary atomizing type coating machine and a rotary atomizing head using the same.

BACKGROUND ART

In an automobile coating line requiring coating at high quality, a rotary atomizing electrostatic coating machine has been popularized since it is excellent in atomizing a coating material and has high deposition efficiency.

FIG. 2 shows such an existent rotary atomizing electrostatic coating machine 21 in which a rotary atomizing head 24 is fitted at the top end of a tubular rotary shaft 23 of a built-in air motor 22.

In the rotary atomizing head 24, a coating material chamber 28 for receiving supply of a coating material from a fine tubular nozzle 27 inserted through the tubular rotary shaft 23 is formed on the rear side of an inner bell 26 fitted to the frontal side of a bell body 25, and a substantially frustconical rim 30 is formed on the frontal side thereof for spreading the coating material jetted out centrifugally from a coating material jetting port 29 formed to the peripheral surface of the coating material chamber 28 and atomizing the same at the top end thereof.

Patent Document 1: Japanese Patent Laid-Open No. 9-94489

Patent Document 2: Japanese Patent Application No. 2003-374909

According to them, when a coating material is supplied from the fine tubular nozzle 27 while rotationally driving the rotary atomizing head 24 at a high speed by the air motor 22, the coating material is caused to flow into the coating material chamber 28, hit against the rear side of the inner bell 26, blown out to the peripheral surface of the coating material chamber 28, caused to flow from the coating material discharge hole 29 to a rim 30 and atomized at a top end thereof.

By the way, abatement of the VOC (Volatile Organic Compound) and $CO_2$ has been highly publicized with an environmental point of view and it has been demanded also in the field of the coating industry to suppress the VOC to be discarded by improving the deposition efficiency of the coating material thereby eliminating the wasteful loss of the coating material and, at the same time, suppressing occurrence of $CO_2$ by decreasing the energy consumed in the combustion treatment of volatile organic substances to be discarded, etc.

In this case, for enhancing the deposition efficiency, atomization of the coating material is necessary and it may be considered to supply air at a high pressure to the air motor 22 of the coating machine 21 to increase the rotational speed of the rotary atomizing head 24 for atomization. However, increase of the rotational speed not only increases the generation amount of scattering coating mist but also increases the consumption amount of the energy, and this is contrary to the demand for the abatement of the VOC and $CO_2$.

In a case where it is possible to attain the atomization of the coating material by low speed rotation of the rotary atomizing head 24, the deposition efficiency will be improved and abatement of the VOC and $CO_2$ can also be attained.

According to the experiment made by the inventor, it has been found that atomization is possible even at low speed rotation when the amount of the coating material to be supplied from the fine tubular nozzle 27 to the coating material chamber 29 is decreased. However, no necessary jetting amount can be obtained in this case to result in a problem that a coating film of a necessary thickness can not be formed within a restricted coating time to a work such as car bodies conveyed continuously on a conveyor thereby lowering the production efficiency.

DISCLOSURE OF THE INVENTION

Subject to be Solved by the Invention

In view of the above, it is a technical subject of the present invention to atomize the coating material to improve the deposition efficiency without lowering the production efficiency and abate the VOC and $CO_2$.

Means for the Solution of the Subject

The present invention provides a coating machine having a rotary atomizing head in which a coating material chamber for receiving supply of a coating material is formed on the rear side, and a substantially frustconical rim is formed on the frontal side for spreading the coating material caused to flow from the coating material chamber by a centrifugal force and atomizing the same at the top end thereof characterized in that a plurality of rims are fitted being overlapped in plurality each at a predetermined clearance to the rotary atomizing head, and each of the clearances is opened to the peripheral surface of the coating material chamber.

Effect of the Invention

According to the coating machine of the invention, upon supplying a coating material while rotating the rotary atomizing head to a coating material chamber formed at the rear side thereof, the coating material is caused to spread to the peripheral surface of the coating material chamber by a centrifugal force.

In the rotary atomizing head, since a plurality of rims are fitted being overlapped each at a predetermine clearance in the coating material chamber and the clearance for each of the rims is opened and formed to the peripheral surface of the coating material chamber, the coating material spread to the peripheral surface of the coating chamber is caused to flow into the clearance for each rim and spread.

Accordingly, in a case where the amount of the coating material supplied to the coating material chamber is constant, the amount of the coating material supplied per one rim is decreased in inverse proportion to the number of rims and, in a case where the rims are overlapped, for example, by the number of four, the amount of the coating material supplied per one rim is decreased to ¼.

In this case, since the amount of the coating material supplied per one rim is small, even when the number of rotation of the rotary atomizing head is set relatively lower, coating material particles can be atomized to an ideal particle size of 20 to 30 μm.

Further, while the jetting amount of the coating material per one rim is decreased, for example, to ¼, since the rims are disposed by the number of five, the entire setting amount of the coating material can be ensured.

As described above, since atomization can be conducted while lowering the number of rotation, it can provide an excellent effect capable of suppressing the coating material mist from scattering to improve the deposition efficiency, decreasing the wasteful loss of the coating material to abate the VOC to be discarded, and saving the energy consumed for combustion treatment thereof, etc, to suppress the occurrence of $CO_2$ and, at the same time, capable of ensuring a necessary jetting amount for maintaining the necessary production efficiency since a plurality of rims are overlapped.

BEST MODE FOR CARRYING OUT THE INVENTION

In this embodiment, the subject of atomizing a coating material to improve the deposition efficiency without lowering the production efficiency thereby abating the VOC and $CO_2$ has been attained by providing a plurality of rims to the rotary atomizing head for rotationally atomizing the coating material.

FIG. 1 is an explanatory view showing an example of a coating machine according to this invention.

A coating machine 1 shown in FIG. 1 is a center feed type rotary atomizing electrostatic coating machine in which a rotary atomizing head 4 is fitted to the top end of a tubular rotary shaft 3 of a built-in air motor 2, and a coating material supplied from the fine tubular nozzle 5 inserted through the tubular rotary shaft 3 to the rotary atomizing head 4 is deposited to a work by an electrostatic force.

In the rotary atomizing head 4, an inner bell 7 is provided on the frontal side of a bell main body 6 fitted to the tubular rotary shaft 3, a coating material chamber 8 for receiving supply of the coating material is formed to the rear side, and a space between the bell main body 6 and the inner bell 7 at the peripheral surface of the coating material chamber 8 is formed as a coating material jetting slit 9.

Then, a plurality of rims $R_1$ to $R_4$ each of a substantially frustconical shape are fitted being overlapped at a predetermined clearance $C_1$ to $C_4$ to the slit 9, and each of the clearances $C_1$ to $C_4$ is opened to the peripheral surface of the coating material chamber 8.

The inner bell 7 is formed with slopes 10, 11 stepwise in view of a cross section along the rotational center shown in FIG. 2 for blowing the coating material supplied to the coating material chamber 8 to each of the clearances $C_1$ to $C_4$ by a centrifugal force.

Thus, when the centrifugal force exerts on the coating material supplied to the inside of the coating material chamber 8, the coating material is blown substantially uniformly from the slopes 10, 11 to each of the clearances $C_1$ to $C_4$ and the coating material flows out through each of the clearance $C_1$ to $C_4$ to the inner surface of the rims $R_1$ to $R_4$ and spread thereon and atomized at the top end of each of rims $R_1$ to $R_4$.

An example of the constitution of the invention is as has been described above and the operation thereof is to be described.

When a coating material is supplied from the fine tubular nozzle 5 under rotation of the rotary atomizing head 4 by the air motor 2 of the coating machine 8, a centrifugal force exerts on the coating material by way of the rotating inner bell 7 and the coating material is blown toward the peripheral surface in the coating material chamber 8.

Since the slopes 10, 11 are formed stepwise in the inner bell 7 for blowing the coating material to each of the clearances $C_1$ to $C_5$, the coating material flowing along the slopes 10, 11 by the centrifugal force is blown uniformly with no localization along the inclined surface of the slopes, 10, 11 toward each of the clearances $C_1$ to $C_4$.

The, the coating material flows out through each of the clearances $C_1$ to $C_5$ to the inner surface of rims $R_1$ to $R_4$ and spread and atomized at the top end of each of the rims $R_1$ to $R_5$.

In a case of atomizing the coating material supplied at 400 cc/min from the fine tubular nozzle 5 to a grain size of 20 to 30 μm, in an existent type rotary atomizing head with only one rim being disposed, since the entire amount is supplied to one rim, rotation has to be conducted at the number of rotation of about 40,000 rpm at the lowest. On the other hand in this embodiment having a plurality of rims $R_1$ to $R_4$ (by the number of four), the amount of the coating material supplied per one rim is decreased to about 100 cc/min, that is, to about one-fourth and the number of rotation of about 10,000 ppm may suffice.

Further, while the amount of the coating material to be atomized at the top end of individual rims $R_1$ and $R_4$ is decreased in inverse proportion to the number of rims, since the entire jetting amount does not change, the production efficiency is not lowered.

As described above, in this invention, since atomization can be conducted at a lowered number of rotation without decreasing the jetting amount, the production efficiency is not lowered.

Further, since the scattering of the coating material mist is suppressed to improve the deposition efficiency, it provides an excellent effect capable of decreasing the wasteful loss of the coating material to reduce the VOC to be treated and, accordingly, capable of saving the energy consumed for the combustion treatment thereof, etc. to suppress the occurrence of the $CO_2$.

INDUSTRIAL APPLICABILITY

The present invention is suitable to be used for a coating machine in a coating line for which high quality coating film is required such as in automobiles bodies.

DESCRIPTION OF REFERENCES

Figure 1:
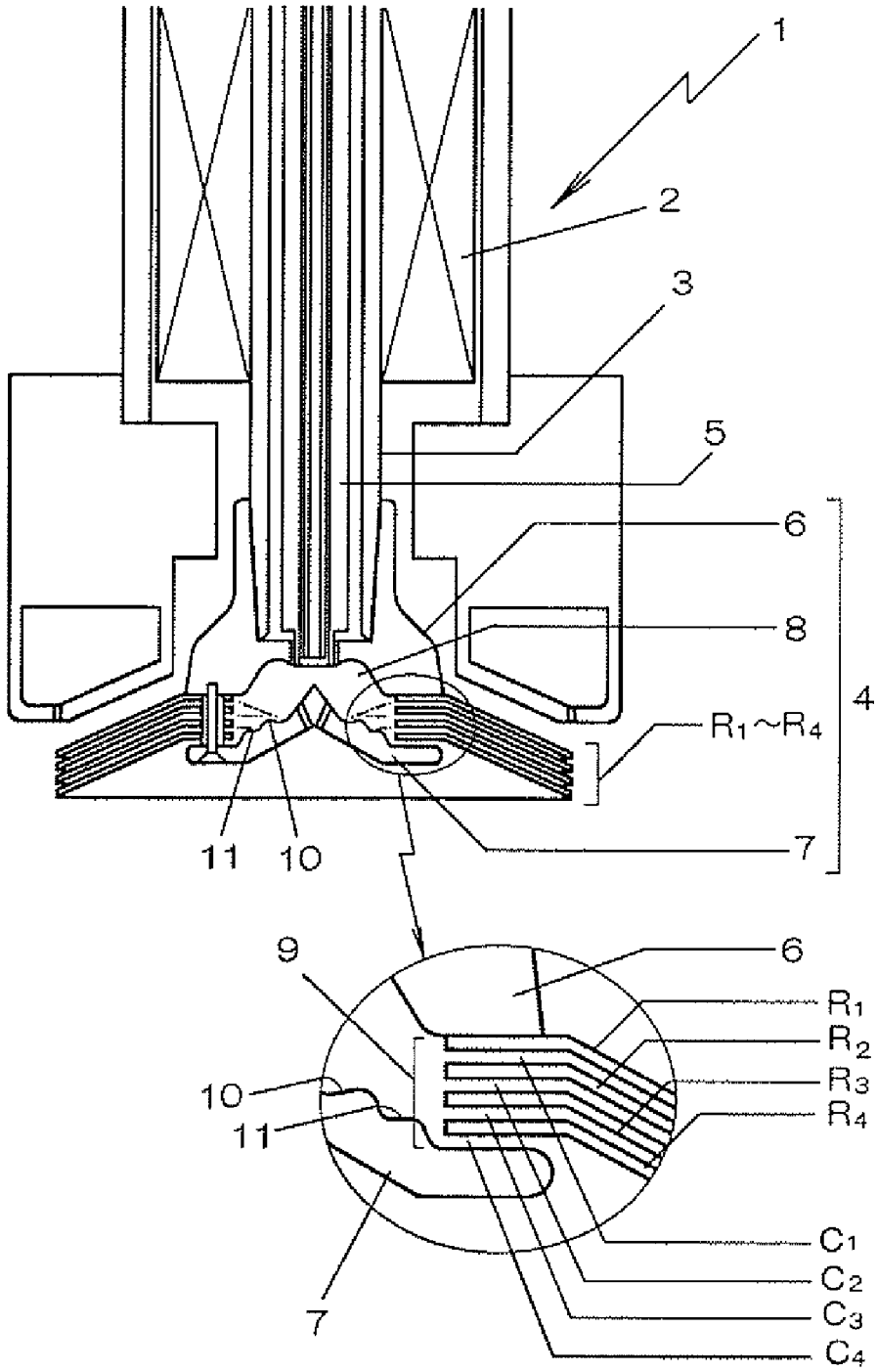
[FIG. 1] is an explanatory view showing a coating machine according to the invention.
Figure 2:
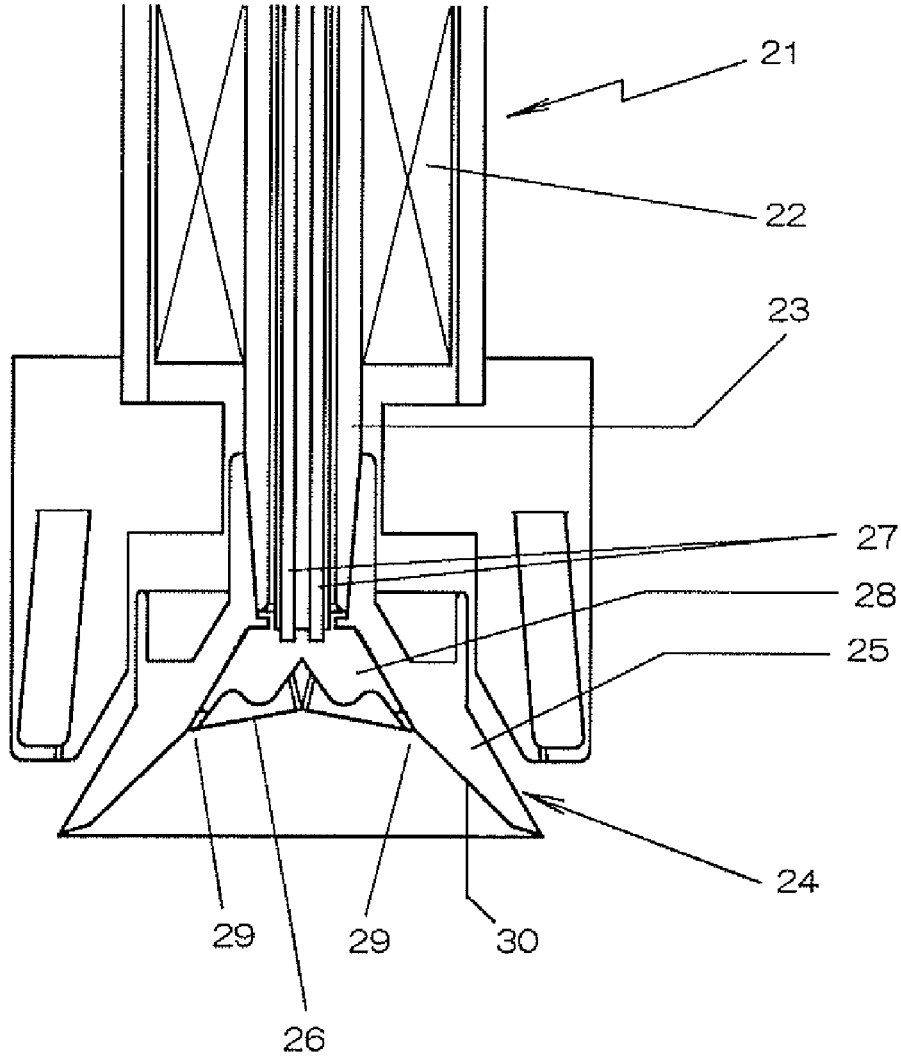
Fig. 2 (prior art)
[FIG. 2] is an explanatory view showing an existent apparatus.

1 coating machine
3 tubular rotary shaft
4 rotary atomizing head
4 fine tubular nozzle
5 bell main body
7 inner bell
8 coating chamber
$R_1$ to $R_4$ rim
$C_1$ to $C_4$ clearance
9 coating material jetting slit
10, 11 slope

The invention claimed is:

1. A coating machine having a rotary atomizing head in which a coating material chamber for receiving supply of a coating material is formed on the rear side of a bell main body fitted to a rotary shaft of the coating machine, and a substantially frustoconical rim is formed on the frontal side for spreading the coating material caused to flow from the coating material chamber by a centrifugal force and atomizing the same at the top end thereof characterized in that a plurality of substantially frustoconical rims are fitted being overlapped in plurality each at a predetermined clearance to the rotary atomizing head, and each of the clearances is opened to the peripheral surface of the coating material chamber;

wherein the rear side of an inner bell is fitted to the front side of the bell main body and the coating material chamber and the inner bell is provided stepwise with slopes in view of the cross section along the center of rotation for blowing out the coating material supplied to the coating material chamber to each of the clearances by a centrifugal force.

2. A rotary atomizing head in which a coating material chamber for receiving supply of a coating material is formed on the rear side of a bell main body fitted to a rotary shaft of a rotary atomizing coating machine, and a substantially frustconical frustoconical rim is formed on the front side for spreading the coating material flown out from the coating material chamber by a centrifugal force and atomizing the same at the top end thereof, in which a plurality of substantially frustoconical rims are fitted being overlapped each at a predetermined clearance to the bell main body, and each of the clearances is opened to the peripheral surface of the coating material chamber;

wherein the rear side of an inner bell is fitted to the front side of the bell main body and the coating material chamber and the inner bell is provided stepwise with slopes in view of the cross section along the center of rotation for blowing out the coating material supplied to the coating material chamber to each of the clearances by a centrifugal force.

* * * * *